US008994357B2

(12) United States Patent
Avitan

(10) Patent No.: US 8,994,357 B2
(45) Date of Patent: Mar. 31, 2015

(54) LOAD ADAPTIVE LOOP BASED VOLTAGE SOURCE

(75) Inventor: Shimon Avitan, Kiryat Ata (IL)

(73) Assignee: Marvell Israel (M.I.S.L) Ltd., Yokneam (IL)

( * ) Notice: Subject to any disclaimer, the term of this patent is extended or adjusted under 35 U.S.C. 154(b) by 328 days.

(21) Appl. No.: 13/468,241

(22) Filed: May 10, 2012

(65) Prior Publication Data

US 2012/0286757 A1 Nov. 15, 2012

Related U.S. Application Data

(60) Provisional application No. 61/485,460, filed on May 12, 2011, provisional application No. 61/554,848, filed on Nov. 2, 2011.

(51) Int. Cl.
*G05F 3/20* (2006.01)
*G05F 1/565* (2006.01)

(52) U.S. Cl.
CPC ..... *G05F 1/565* (2013.01)
USPC ..... 323/315; 323/311; 323/312

(58) Field of Classification Search
CPC ..... G05F 3/262; G05F 3/30
USPC ..... 323/267, 268–26, 273–285, 315, 323/268–269, 311–317
See application file for complete search history.

(56) References Cited

U.S. PATENT DOCUMENTS

| | | | | |
|---|---|---|---|---|
| 8,179,115 | B2 * | 5/2012 | Wang | 323/313 |
| 8,531,171 | B1 * | 9/2013 | Sutardja et al. | 323/314 |
| 2006/0279269 | A1 * | 12/2006 | Yang | 323/313 |
| 2007/0200538 | A1 * | 8/2007 | Tang et al. | 323/237 |
| 2008/0191670 | A1 * | 8/2008 | Oddoart et al. | 323/273 |
| 2010/0164460 | A1 * | 7/2010 | Hsiao et al. | 323/284 |
| 2010/0176875 | A1 * | 7/2010 | Pulijala et al. | 327/538 |
| 2011/0156686 | A1 * | 6/2011 | Gakhar et al. | 323/284 |
| 2012/0032656 | A1 * | 2/2012 | Hoon et al. | 323/268 |

* cited by examiner

*Primary Examiner* — Nguyen Tran
*Assistant Examiner* — Shahzeb K Ahmad

(57) ABSTRACT

Systems and methods are provided for a power supply. A first output stage is configured to supply power from a power source at a target voltage to a device in an integrated circuit in response to a power demand of the device. Load detector circuitry is configured to detect a load resulting from operation of the device, and a supplemental output stage is configured to selectively supply supplemental power from the power source to the device, in addition to the power provided by the first output stage, in response to detection of an additional load resulting from operation of the device.

17 Claims, 5 Drawing Sheets

LOAD ADAPTIVE LOOP BASED VOLTAGE SOURCE

CROSS-REFERENCE TO RELATED APPLICATIONS

This application claims priority to U.S. Provisional Patent Application No. 61/485,460, filed May 12, 2011, entitled "Load Adaptive Loop Based Voltage Source," and to U.S. Provisional Patent Application No. 61/554,858, filed Nov. 2, 2011, entitled "Load Adaptive Loop Based Voltage Source," both of which are herein incorporated in their entirety.

FIELD

The technology described herein relates generally to a voltage source and more particularly to a load adaptive voltage source.

BACKGROUND

In many applications, a power consumer, such as a load or device, changes its need for power during operation. Such a power consumer functions best when that power is provided within a reasonable range of voltages (for example, within 10% of a target (rated) voltage of the device). An ideal regulator is able to supply different levels of power while maintaining the supplied power at a constant voltage level despite changes to the magnitude of the supplied power.

A practically implemented regulator (such as, for example, a semi-regulated regulator circuit) typically lacks various capabilities of an ideal regulator. Although a practical regulator is typically designed to provide constant or near constant power at a desired target voltage, performance of the typical practical regulator suffers when the power demand of a power consumer changes dramatically. Dramatic power changes in power demand may occur, for instance, when a data transmitter device switches from transmitting data at a low data rate to transmitting data at a high data rate.

The description above is presented as a general overview of related art in this field and should not be construed as an admission that any of the information it contains constitutes prior art against the present patent application.

SUMMARY

Examples of systems and methods are provided for a power supply. In one embodiment of the disclosure, a first output stage is configured to supply at least partially regulated power from a power source at a target voltage to a device in an integrated circuit in response to a power demand of the device. Load detector circuitry is configured to detect a load resulting from operation of the device, and a supplemental output stage is configured to selectively supply supplemental power from the power source to the device, in addition to the power provided by the first output stage, in response to detection of an additional load resulting from operation of the device.

In another embodiment of the disclosure, a method of supplying power includes providing at least partially regulated power to a device on an integrated circuit from a power source at a target voltage using a first output stage. A power demand of the device is detected using a load detector, and supplemental power is selectively provided to the device from the power source using a supplemental output stage in response to detection of an additional load resulting from operation of the device.

In a further embodiment of the disclosure, a data transmitter fabricated on an integrated circuit includes an output driver configured to selectively transmit data at a low data rate and at a high data rate, where transmitting at the high data rate requires greater power than when transmitting at the low data rate. A power supply is configured to adaptively supply the required power to the output driver, where the power supply includes a first output stage that is configured to supply at least partially regulated power from a power supply to the output driver on the integrated circuit at a rated voltage for transmitting data at the low data rate and a supplemental output stage that is responsive to a load on the circuit for transmitting data at the high data rate and that is configured to provide a portion of the required power from the power source to the output driver for transmitting data at the high data rate.

DETAILED DESCRIPTION

Figure 1:
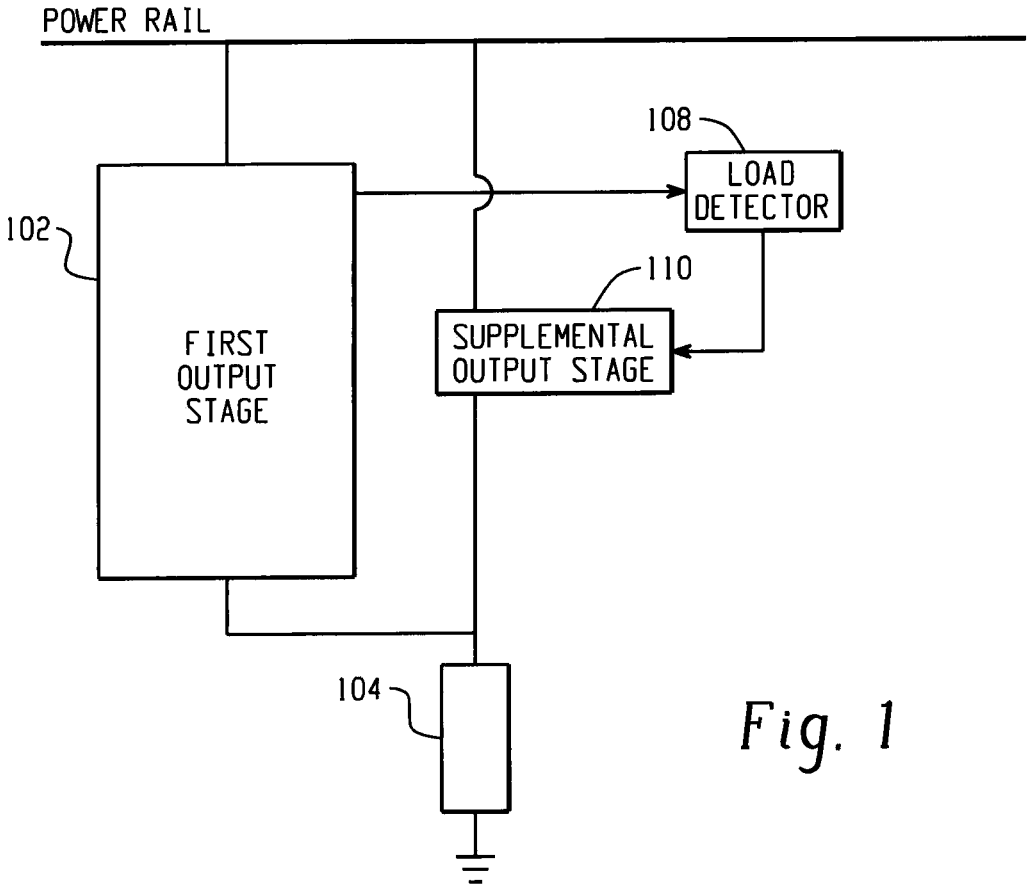
FIG. 1 is a simplified block diagram depicting a power supply in accordance with an embodiment of the disclosure.

FIG. 1 is a simplified block diagram depicting a power supply in accordance with an embodiment of the disclosure. A first output stage 102 is configured to provide power to a device 104, where the device 104 has a target voltage at which the device 104 best performs. In an example, the first output stage 102 is a module in a semi-regulated power supply that is configured to supply at least partially regulated power to the device 104 based upon a power demand of the device 104. The at least partially regulated power provided by the first output stage 102 in an embodiment is often well suited for addressing "slow" changes in the power demand, such as those changes that are process or temperature dependent. However, the at least partially regulated power of the first output stage 102 is typically not suitable for supplying power at a constant voltage when large or fast changes in the power demand are present. When power demands vary substantially from baseline levels, the voltage at which the first output stage 102 is able to provide power to the device 104 may deviate. In some embodiments, such deviation by the first output stage 102 may be temporary until the first output stage 102 is able to recover and provide the new power level near the target voltage. In other embodiments, the first output stage 102 is unable to recover and can only provide the new power at the deviating voltage level.

Load detector circuitry 108 is configured to detect a load resulting from operation of the device 104. A supplemental output stage 110 is configured to selectively supply a portion of the power demand of the device 104, in addition to the power supplied by the first output stage 102, in response to detection of an additional load resulting from operation of the device 104. The supplemental output stage 110 is not necessarily regulated but in combination with the first output stage 102 is able to maintain a constant voltage in an event of spikes in power demand.

Figure 2:
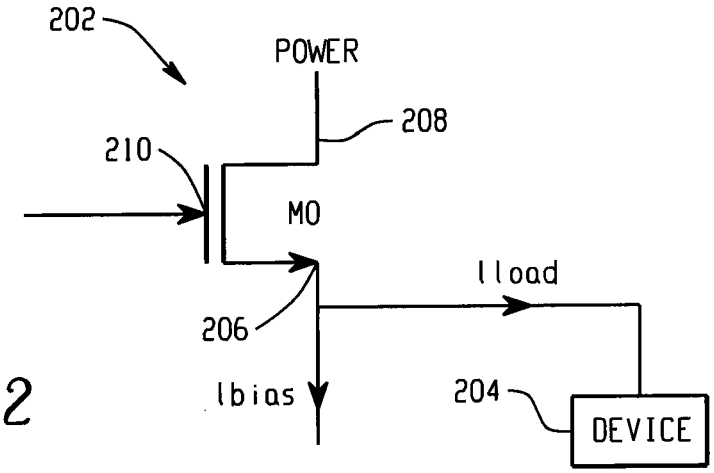
FIG. 2 depicts an example of the first output stage depicted in FIG. 1.

The first output stage 102 may take a variety of forms. For example, FIG. 2 depicts an example of the first output stage depicted in FIG. 1. In an embodiment, the depicted first output stage includes an output transistor 202, biased with a bias current ($I_{bias}$) that is connected to a device 204 via a low impedance terminal 206 (for example, a source terminal). The high impedance terminal 208 (for example, a drain terminal) is connected to a power rail (power source). The output transistor is controlled via its gate terminal 210 or via its source terminal 206.

In many cases, a first output stage is bandwidth limited and does not react well to fast changes in the current consumption ($I_{load}$) of the device 204. For example, if the current through the device 204 changes dramatically, and the first output stage is unable to react sufficiently, then the voltage at the low impedance terminal 206 may drop or rise, such that the voltage deviates from a target voltage of the device 204, such as is shown in FIG. 3 at 310 below.

An example device, such as the device depicted at 104 in FIG. 1, optimally operates at a target voltage or target range of voltages. In an embodiment, when operating at the target voltage, the device 104 operates efficiently and exhibits a relatively long component life. While the device 104 may still perform when power is received at a voltage other than the target voltage, such performance may be suboptimal. For example, the device 104 may experience higher energy losses, greater component wear, and sub-optimal performance when the provided voltage deviates from the target voltage of the device 104. Such performance degradation may be exacerbated the further the provided voltage is from the target voltage of the device 104. As a further example, a wireless transmitter may still transmit data when receiving an out of range voltage but at a transmission power level that is outside of a specification according to which the wireless transmitter is desired to utilize.

Figure 3:
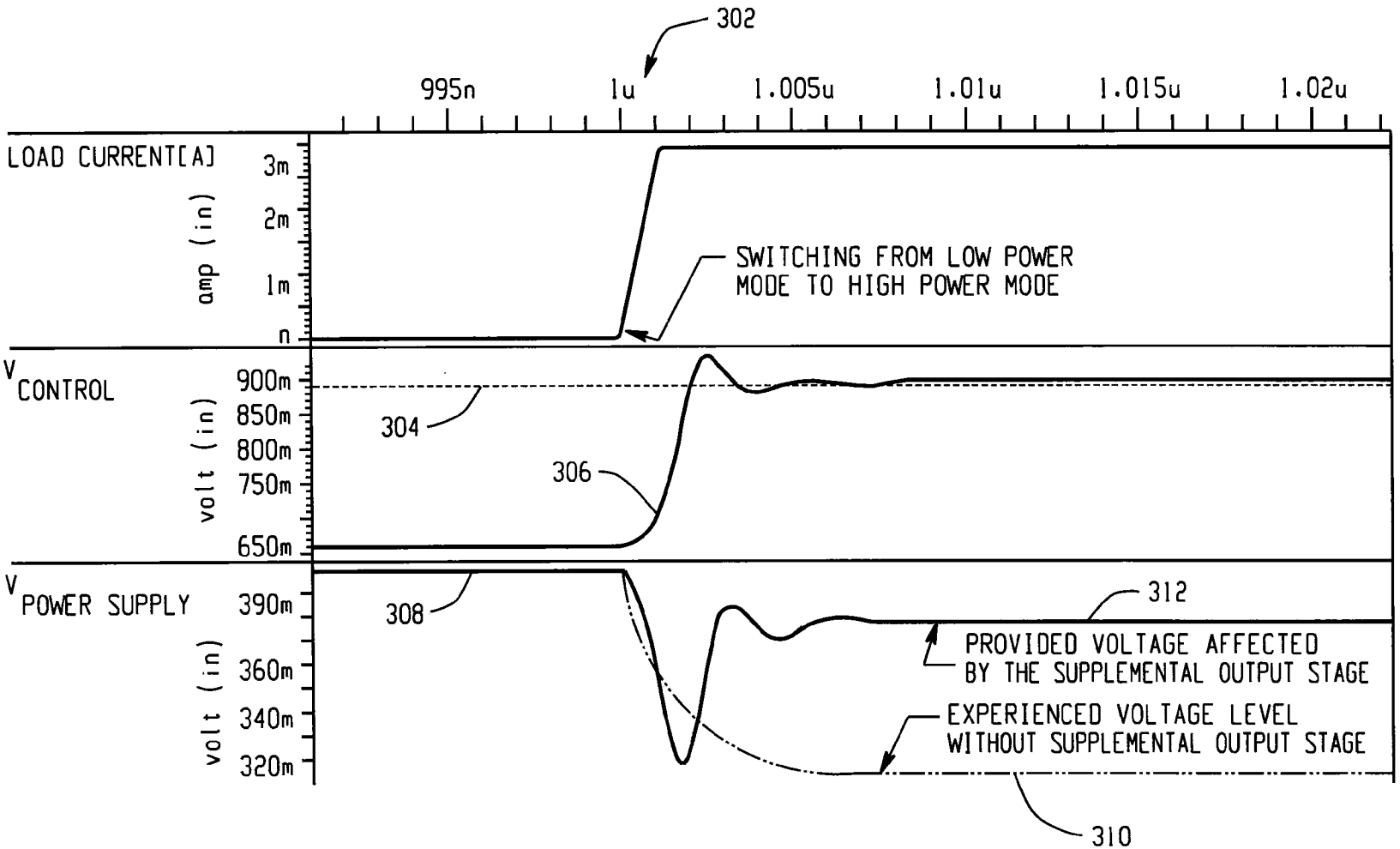
FIG. 3 is a graph depicting an example deviance of the voltage at which power is provided by a first output stage alone and an example stabilization in the provided voltage when a supplemental output stage is utilized.

FIG. 3 is a graph depicting an example deviance of the voltage at which power is provided by a first output stage alone and an example stabilization in the provided voltage when a supplemental output stage is utilized. The top graph depicts the load current, an indicator of the power demand of the device. At 302, the load current transitions from a first level up to a second, higher level. Such a transition could occur, for example, when a transmitter transitions from a low data rate transmission mode to a high data rate transmission mode.

The middle graph of FIG. 3 depicts control inputs to both a first output stage and a supplemental output stage. The control input to the first output stage 304, for example the gate voltage of transistor 410 shown in FIG. 4 below, is on throughout the time period depicted in FIG. 3, indicating that the first output stage is on and supplying power to the device when the device is in a low power demand mode (pre-302) and a high power demand mode (post-302). When the power demand of the device transitions at 302, the transition is sensed by a load detector, such as load detector 108 in FIG. 1, and the load detector transitions the control input to the supplemental output stage 306, such as the gate voltage of transistor 418 shown in FIG. 4 below, instructing the supplemental output stage to provide a portion of the power demand to the device.

The bottom graph of FIG. 3 depicts the voltage at which power is supplied to the device by a power supply. Before the transition of the power demand at 302, power is being provided to the device by the first output stage at a first voltage, indicated at 308. If the first output stage is optimized to supply regulated or semi-regulated power to the device when the device is operating in a low power mode, then the provided voltage indicated at 308 is preferably at or near a target voltage of the device.

The dashed line depicted at 310 in FIG. 3 depicts a drop in the provided voltage that would be experienced by the device if power were provided solely by the first output stage, as the first output stage alone is unable to quickly respond to instantaneous changes in power demand, such as those introduced by a newly added load, or may not be capable of adequately responding to keep the voltage at which power is supplied near the target voltage of the device. In an embodiment, the first output stage is unable to provide the increased power demanded after the transition at 302 at the target voltage indicated at 308. Thus, the first output stage alone would provide the power demanded by the device at the lower voltage indicated at 310, which could result in degraded performance of the device, such as an inability to properly transmit data in a high data rate mode until the first output stage is able to adapt and provide the increased power demand at or near the target voltage again, if the first output stage is able to adapt at all.

The solid line 312 in the bottom graph of FIG. 3 indicates the provided voltage in an embodiment when the first output stage works in combination with the supplemental output stage to provide the power demanded by the device. When the power demand of the device transitions at 302, the supplemental output stage is turned on in response to detection of an increased load by load detector, as indicated at 306. After a transition period, the provided voltage stabilizes at a voltage indicated at 312 that is at or close to the voltage provided when the device was in a low power demand mode (for example, at 308). If these voltages 308, 312, are near the target voltage of the device, then quality performance of the device can be maintained.

Figure 4:
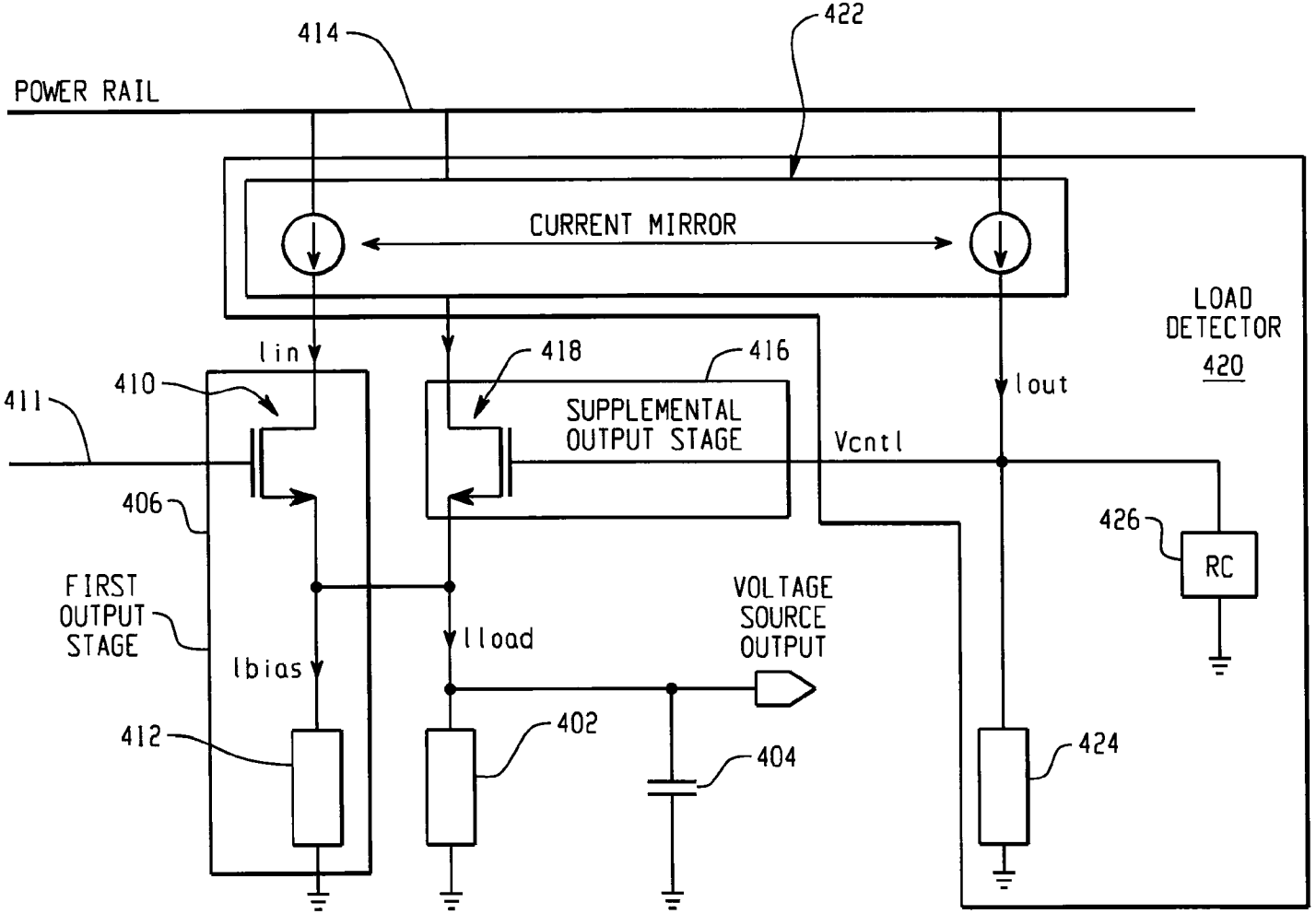
FIG. 4 is a circuit diagram of an embodiment of the power supply depicted in FIG. 1 where a first output stage operates in combination with a supplemental output stage.

FIG. 4 is a circuit diagram of an embodiment of the power supply depicted in FIG. 1 where a first output stage operates in combination with a supplemental output stage. In an embodiment, the circuit includes a device 402 and a filter capacitor 404 connected in parallel with the device 402 between a ground node and outputs of a first output stage 406 and a supplemental output stage 416.

The first output stage 406 includes a metal oxide semiconductor field effect transistor (MOSFET) 410 whose source node acts as an output of the first output stage 406. The first output stage 406 further includes a bias load 412 that is resistive or active in nature, which is designed to maintain a minimum current, $I_{bias}$, when the current demanded by the device, $I_{load}$, is significantly low. The first output stage transistor 410 is controlled at its gate terminal by a regulation signal 411, and the first output stage transistor 410 accesses power to provide to the device 402 at its drain terminal from a power rail 414. In an embodiment, the first output stage 406 is designed to provide power at a target voltage of the device 402 when the device 402 is operating in a low power mode. In such an embodiment, the first output stage transistor 410 is selected to be small enough (for example, via a small width to length (W/L) ratio) to support the minimum power demand device 402, such that the minimum power demand is provided at or near the target voltage of the device 402.

A supplemental output stage 416 is configured to selectively supply a portion of the power demand of the device 402 to the device 402 when the power demand of the device 402 is greater than a threshold power level. The supplemental output stage 416 includes a MOSFET 418 or other transistor device connected in parallel with the first output stage transistor 410 between a power rail and the device 402. The supplemental output stage transistor 418 is selected to be large enough (for example, via a large width to length (W/L) ratio) to support the maximum power demand of the device 402 at or near the target voltage of the device 402 (for example, W/L of the supplemental output stage transistor 518 is greater than W/L of the first output stage transistor 510). The supplemental output stage transistor 418 accesses power (current) to provide to the device 402 at its drain terminal from the power rail 414. The supplemental output stage transistor 418 provides power from its source terminal, which acts as an output of the supplemental output stage 416 to the device 402.

The supplemental output stage transistor 418 is controlled by its gate terminal, where the gate terminal control signal $V_{cntl}$ is regulated by the load detector 420, in an embodiment. The load detector 420 detects the power demand of the device 402 by detecting a current demanded of the first output stage 406 by the device 402. In an embodiment, the load detector 420 implements this detection via a current mirror 422. The current mirror 422 senses the current $I_{in}$ provided to the drain terminal of the first output stage transistor 410 and provides a current that is proportional to $I_{in}$ at $I_{out}$. For example, in an embodiment the proportional current at $I_{out}$ is proportional to $I_{in}$ but at a smaller magnitude than $I_{in}$ for power savings purposes. $I_{out}$ is provided to a resistive (or active) circuit 424 to generate a control voltage $V_{cntl}$. The resistive circuit 424 is connected in parallel with a compensation circuit 426 to maintain a desired phase margin. The resistive circuit 424 is selected so as to control the operating characteristics of the supplemental output stage 416. For example, in an embodiment, a resistance level of the resistive circuit controls the control voltage $V_{cntl}$ provided to the gate of the supplemental output stage transistor 418. When the control voltage $V_{cntl}$ is greater than the threshold voltage of the supplemental output stage transistor 418, then the supplemental output stage 416 will begin providing a portion of the power demand of the device 402. Because the control voltage $V_{cntl}$ is based on the resistance level of the resistive circuit 424 and $I_{out}$, which is associated with the power demand of the device 402, selection of the resistance level of the resistive circuit 424 controls the threshold power level ($V_{cntl} \approx I_{out} * R_{resistive\ circuit}$; $I_{out}\ \alpha\ I_{in}$; $I_{in}\ \alpha$ Power $Demand_{Device}$). When the power demand of the device 402 exceeds the threshold power level, the load detector 420 will detect that condition, and will turn on the supplemental output stage transistor 418 to provide a portion of the power demand to the device 402 in combination with power provided by the first output stage to raise the provided voltage toward the target voltage of the device 402.

Figure 5:
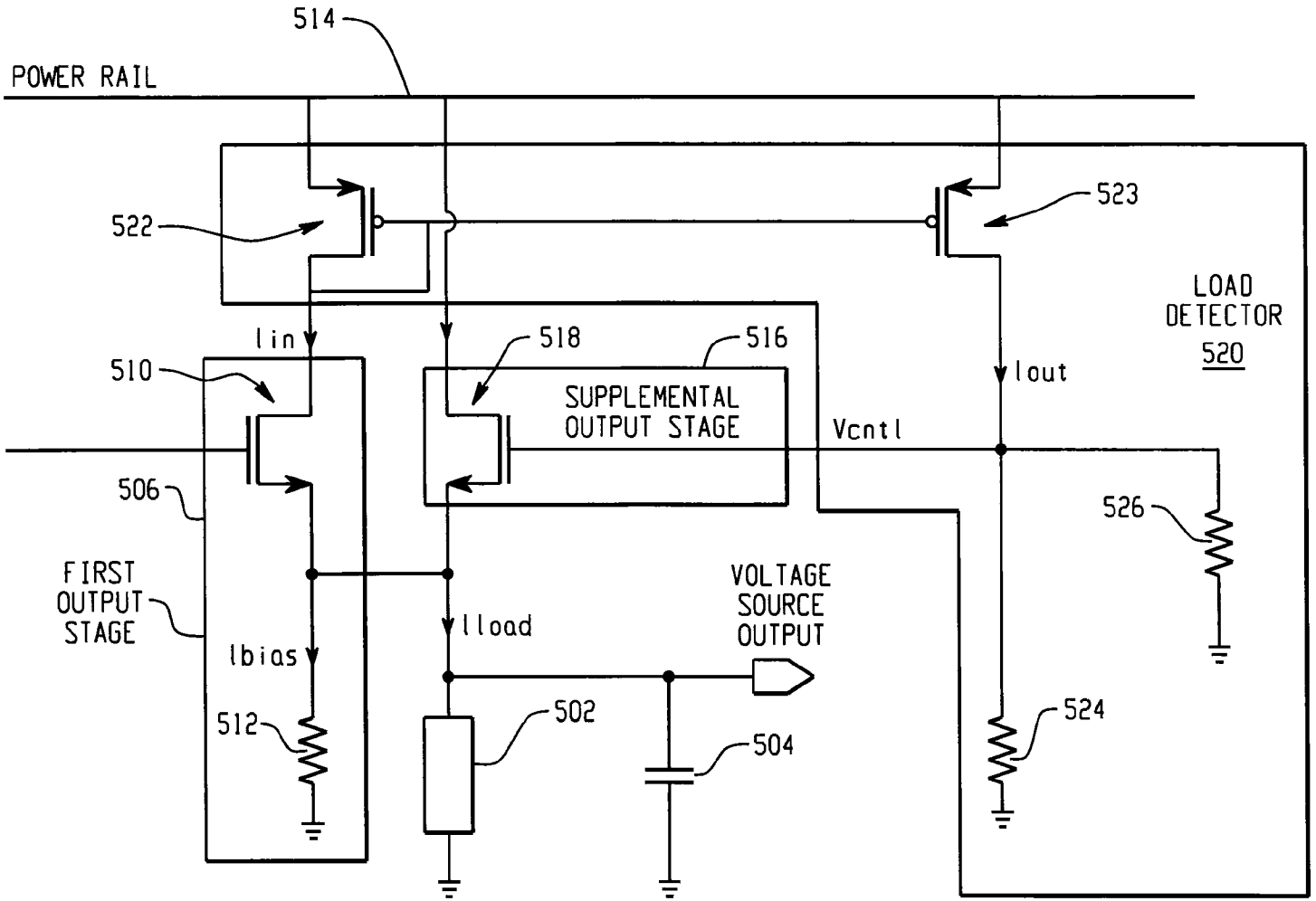
FIG. 5 is a circuit diagram depicting example circuit elements of an embodiment of a power supply depicted in FIG. 4.

FIG. 5 is a circuit diagram depicting example circuit elements of an embodiment of a power supply depicted in FIG. 4. A device includes a load 502 connected in parallel with a filter capacitor 504 at an output of a first output stage 506 and a supplemental output stage 516. The first output stage 506 includes a first output stage transistor 510 and a bias resistor 512. The first output stage 506 provides power to the load 502 from a power rail 514.

The supplemental output stage 516 comprises a supplemental output stage transistor 518 that selectively supplies a portion of the power demand of the load 502 based on a received control signal $V_{cntl}$. A load detector 520 includes a current mirror that, in an embodiment, comprises two gate-connected transistors 522, 523, where the first current mirror transistor 522 is connected in series between the first output stage 506 and the power source 514, and where the second current mirror transistor 523 is connected to the power source 514. The current mirror transistors 522, 523 generate a current $I_{out}$ based on a current to the first output stage 506 $I_{in}$ that is proportional to the power demand of the load 502. The current $I_{out}$ and the resistive circuit 524, connected in parallel with a compensation network 526, generate the control voltage $V_{cntl}$ that selectively activates the supplemental output stage transistor 518 when the power demand of the load 502 exceeds a threshold power level, allowing additional power to be supplied to the load 502 through the supplemental output stage.

Figure 6:
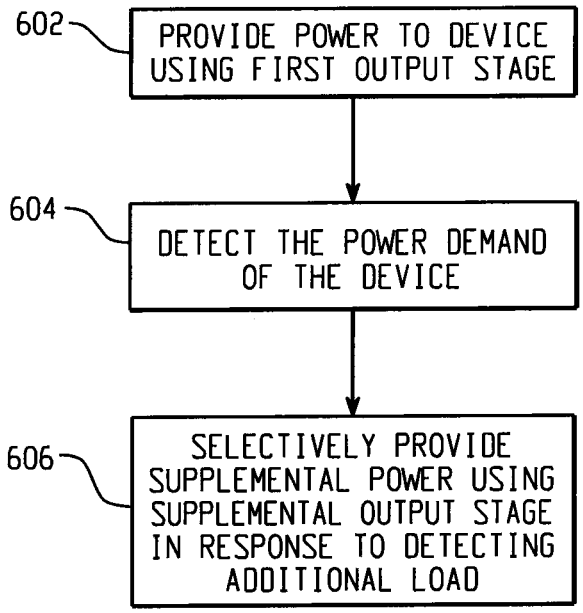
FIG. 6 is a flow diagram depicting a method of supplying power.

FIG. 6 is a flow diagram depicting a method of supplying power. At 602, power is provided to a device from a power source at a target voltage using a first output stage. At 604, a power demand of the device is detected using a load detector. At 606, supplemental power is selectively provided to the device from the power source using a supplemental output stage in response to detection of an additional load resulting from operation of the device.

The patentable scope of the invention may include other examples. For example, in an embodiment, a power supply is configured to operate in modes. In one embodiment, the power supply is configured to operate in a low power mode and a high power mode. The power supply is configured to operate in the low power mode when the power demand is below a threshold power level. In the low power mode, the first output stage supplies all of the power demand of the device. Further, the power supply is configured to operate in the high power mode when the power demand is above a threshold power level. In the high power mode, the first output stage and the supplemental output stage contribute to provide the power demand of the device.

Figure 7:
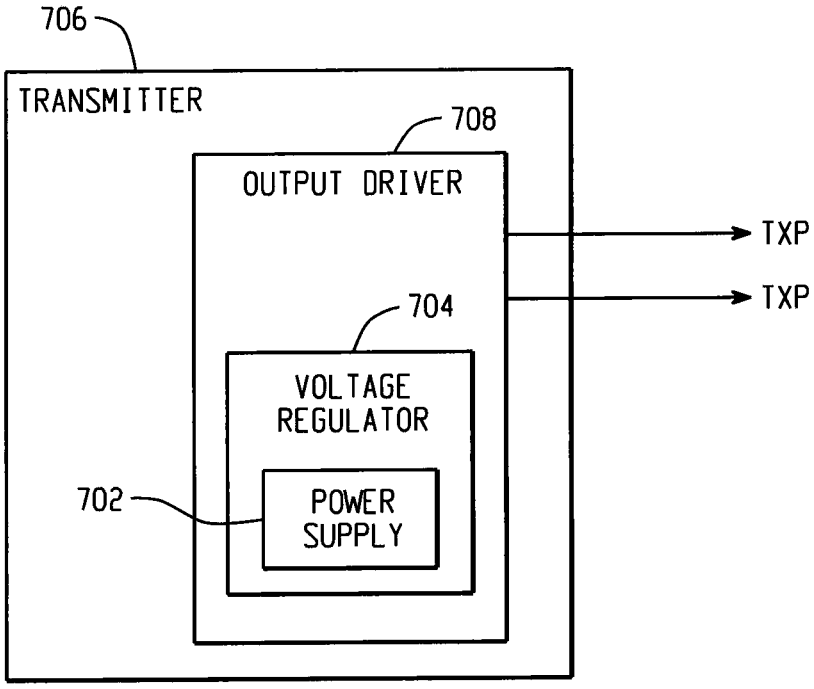
FIG. 7 is a diagram depicting an example implementation of a power supply in a transmitter circuit.

As another example, FIG. 7 is a diagram depicting an example implementation of a power supply in a data transmitter circuit. A power supply 702, as described herein is incorporated into a driver voltage regulator 704 of a transmitter (wireless or wired) unit 706 (for example a MIPI based PHY residing at 1.5 GBPS SER-DES for a cellular telecommunications device). Specifically, in an embodiment, the power supply 702 is implemented as part of an output driver 708 of the transmitter unit 706. For example, when the transmitter 706 directs the output driver 708 to transmit in a low power mode, the required power is provided by a first output stage, and when the transmitter 706 directs the output driver 708 to transmit in a high power mode, the required power is selectively supplemented by a supplemental voltage supply. The first output stage and the second output stage operate in conjunction with one or more amplifiers of the voltage regulator 704 to power the output driver 708 of the transmitter unit 706.

As an additional example, components of the described power supply are fabricated together or separately on one or more hardware components. For example, a first output stage is fabricated on a same integrated circuit (chip) as a supplemental output stage. The components of a power supply may also be fabricated on the same (for example, a same integrated circuit) or a different hardware component as the device that the power supply is to drive. Example devices can include a processor, including any hardware device for processing data, such as a data processor or central processing unit, an integrated circuit or other chip, an application-specific integrated circuit, a field programmable gate array, a memory, hardwired circuit components, a transmitter, a receiver, or other devices.

What is claimed is:

1. A power supply, comprising:

a first output stage configured to, in response to a power demand of a device, output at least partially regulated power from a power source at a target voltage to the device wherein the partially regulated power supplied to the device deviates from the target voltage in response to the power demand of the device changing at a rate above a predetermined threshold, and wherein the first output stage comprises a first output stage transistor connected between the power source and the device;

load detector circuitry configured to, while the device is being supplied the partially regulated power from the power source, detect a load resulting from operation of the device; and a supplemental output stage comprising a supplemental output transistor configured to, in response to detecting that the load resulting from operation of the device causes the power demand of the device to change at a rate that exceeds the predetermined threshold, selectively output supplemental power from the power source to the device in, combination with the regulated power supplied by the first output stage, wherein both the first output stage and the supplemental output stage output power to the device simultaneously to maintain the power being supplied to the device at the target voltage, and wherein a terminal of the first output stage transistor connected to (i) a terminal of the supplemental output transistor and (ii) the device.

2. The power supply of claim 1, wherein the power supply is configured to selectively operate in one of a low power mode and a high power mode;

wherein the power supply is configured to operate in the low power mode when the power demand of the device is below a threshold power level, and wherein the first output stage supplies all of the power demand of the device in the low power mode;

wherein the power supply is configured to operate in the high power mode when the power demand of the device is above a threshold power level, and wherein the first output stage and the supplemental output stage contribute to provide the power demand of the device in the high power mode.

3. The power supply of claim 2, wherein the power supply is implemented as part of a transmitter, and wherein the load detector is configured to detect that the load resulting from operation of the device causes the power demand of the device to increase when the transmitter transitions from a low data rate mode to a high data rate mode.

4. The power supply of claim 1, wherein the supplemental output stage is configured to provide a portion of the power demanded by the device when a voltage level detected by the load detector exceeds a threshold voltage level.

5. The power supply of claim 1, wherein the load detector circuitry comprises a current mirror that is configured to sense a current demanded of the first output stage.

6. The power supply of claim 5, wherein an output of the current mirror is provided to a resistive circuit to generate a control voltage; and wherein a gate of the supplemental output stage transistor is coupled to and controlled by the control voltage.

7. The power supply of claim 5, wherein the current mirror comprises two transistors having connected gate terminals, wherein a first current mirror transistor is configured to be connected between the first output stage and the power source, and wherein a second current mirror transistor is connected to the power source.

8. The power supply of claim 1, wherein the first output stage is configured to provide the power demand alone when the first output stage is able to supply the power demand at a voltage that is within ±10% of the target voltage.

9. The power supply of claim 1, wherein the power supply is configured to supply power for driving a data transmission, and wherein the supplemental output stage is configured to supply the supplemental power when data is being transmitted at a data rate that exceeds a transmission rate threshold.

10. A method of supplying power, comprising:

outputting, in response to a power demand of a device, at least partially regulated power to a device in an integrated circuit from a power source at a target voltage using a first output stage through a first output stage transistor connected between the power source and the device, wherein the partially regulated power that is output to the device deviates from the target voltage in response to the power demand of the device changing at a rate above a predetermined threshold;

detecting, while the device is being supplied the partially regulated power from the power source, a power demand of the device using a load detector; and selectively outputting, in response to detecting that the load resulting from operation of the device causes the power demand of the device to change at a rate that exceeds the predetermined threshold, supplemental power to the device from the power source through a supplemental output transistor of a supplemental output stage wherein both the first output stage and the supplemental output stage output power to the device simultaneously to maintain the power being supplied to the device at the target voltage, and wherein the first output stage transistor provides power via a terminal that is connected to (i) a terminal of the supplemental output transistor and (ii) the device.

11. The method of claim 10, wherein detecting the power demand of the device comprises using a current mirror to generate a control voltage based on a current provided to the first output stage by the power source.

12. A data transmitter fabricated on an integrated circuit, comprising:

an output driver configured to selectively transmit data at one of a low data rate and a high data rate, wherein transmitting at the high data rate requires greater power than transmitting at the low data rate; and a power supply configured to adaptively supply the required power to the output driver, wherein the power supply comprises:

a first output stage that comprises a first output stage transistor connected between the power source and the driver, wherein the first output stage is configured to output, through the first output stage transistor, at least partially regulated power from the power supply to the output driver at a rated voltage for transmitting data at the low data rate, wherein partially regulated power that is output to the driver deviates from the target voltage in response the output driver transmitting data at the high data rate; and a supplemental output stage comprising a supplemental output transistor, the supplemental output stage being configured to, in response to a detected load on the circuit corresponding to a power requirement for transmitting data at the high data rate, output a portion of the required power from the power source to the output driver for transmitting data at the high data rate, wherein both the first output stage and the supplemental output stave are configured to output power to the output driver simultaneously to maintain the rated voltage for transmitting data at the high data rate, and wherein a terminal of the first output stage transistor is connected to (i) a terminal of the supplemental output transistor and (ii) the device.

13. The data transmitter of claim 12, wherein the power supply is configured to selectively operate in one of a low power mode and a high power mode;

wherein the power supply is configured to operate in the low power mode when the required power is below a threshold power level, and wherein the first output stage supplies all of the required power of the output driver in the low power mode;

wherein the power supply is configured to operate in the high power mode when the required power is above a threshold power level, and wherein the first output stage and the supplemental output stage contribute to provide the required power of the output driver in the high power mode.

14. The data transmitter of claim 12, wherein the supplemental output stage is configured to supply a portion of the required power of the output driver to raise a voltage at which the power is supplied toward the target voltage when the required power of the output driver is greater than a threshold required power level.

15. The data transmitter of claim 12, wherein the supplemental output stage is configured to provide a portion of the required power of the output driver when a detected voltage level exceeds threshold voltage level.

16. The data transmitter of claim 12, wherein the supplemental output stage comprises load detector circuitry that comprises a current mirror that is configured to sense a current demanded of the first output stage.

17. The data transmitter of claim 16, wherein an output of the current mirror is provided to a resistive circuit to generate a control voltage;

wherein the supplemental output stage comprises a supplemental output stage transistor, wherein a gate of the supplemental output stage transistor is coupled to and controlled by the control voltage.

* * * * *